US007136327B2

(12) United States Patent
Hopkins

(10) Patent No.: US 7,136,327 B2
(45) Date of Patent: Nov. 14, 2006

(54) TEACHING HANDS FOR AN ANALOG TIMEPIECE

(75) Inventor: Janet Elise Hopkins, Peterborough, NH (US)

(73) Assignee: Silver Lining Multimedia, Inc, Peterborough, NH (US)

( * ) Notice: Subject to any disclaimer, the term of this patent is extended or adjusted under 35 U.S.C. 154(b) by 199 days.

(21) Appl. No.: 10/711,184

(22) Filed: Aug. 31, 2004

(65) Prior Publication Data

US 2006/0044945 A1 Mar. 2, 2006

(51) Int. Cl.
*G04B 19/04* (2006.01)

(52) U.S. Cl. ..... 368/238; 434/304

(58) Field of Classification Search ..... 368/228, 368/238, 229–231; 434/304
See application file for complete search history.

(56) References Cited

U.S. PATENT DOCUMENTS 171,958 A * 1/1876 Spooner ..... 229/155
328,122 A * 10/1885 Dietz ..... 141/24
1,851,824 A * 3/1932 Fewell ..... 368/228
3,142,148 A * 7/1964 Morgan et al. ..... 368/238
3,358,437 A * 12/1967 Burg ..... 368/27
4,124,945 A 11/1978 Totten
4,219,943 A 9/1980 Grimes
5,030,104 A 7/1991 Caldwell
5,134,596 A * 7/1992 Harris ..... 368/80
6,071,124 A 6/2000 Ang
2005/0254351 A1* 11/2005 Brown et al. ..... 368/80

* cited by examiner

*Primary Examiner*—Vit W. Miska
*Assistant Examiner*—Sean Kayes

(57) ABSTRACT

Novel hour and minute hands for teaching reading and passage of time on an analog timepiece. The invention comprises hour and minute hands located centrally and pivotally on the timepiece. The hour hand having at its outer tip a shape through which the hour numerals can be read. The shaft of the hour hand being of a length such that the shape at the tip highlights the correct hour numeral. The shape is sized and positioned on the tip of the hour hand such that when the shaft is set to normal hour hand positions, the correct hour numeral is visible through the shape. The minute hand having at its outer tip a shape through which the minute numerals can be read. The minute hand being of a length such that the hollow shape highlights the correct minute numeral.

13 Claims, 6 Drawing Sheets

TEACHING HANDS FOR AN ANALOG TIMEPIECE

FIELD OF THE INVENTION

This invention relates generally to timepieces, specifically to a novel design of hour and minute hands for clocks, watches, and educational materials to be used by individuals who are learning to tell time on an analog timepiece.

DESCRIPTION OF PROBLEM

Learning to tell time on an analog timepiece is difficult for the average child and particularly hard for a special-needs individual. The hands on a typical analog clock are difficult for students to understand for the following reasons:

a) The hands point to both the hour and minute numerals without clearly showing which numeral should be read. For example, when the hour hand is on 2 hours it could also be read as 10 minutes.

b) Even if the student understands which hand points to the hour numerals and which points to the minutes, the student usually becomes confused when the hour hand is between two hour numerals. For example, at 2:30, the hour hand is halfway between the 2 and the 3. Some students would say that it was 3:30 instead of 2:30 because they would not know which number to read.

DESCRIPTION OF PRIOR ART

Many teaching clocks exist which attempt to solve the aforementioned problems by using unique clock face designs. For example, U.S. Pat. No. 6,071,124 uses a clock face with words between the hour numerals to help the student read the correct numeral. U.S. Pat. No. 4,219,943 and U.S. Pat. No. 4,124,945 use color-coordinated segments to guide the student's eye to the correct hour numeral. U.S. Pat. No. 5,030,104 uses sector shapes having common border lines so that the hour hand and minute hand indicate the correct hour and minute even when these hands point to a space between two numerals or directly on a sector border line.

None of the aforesaid devices have the advantage of the present invention. Unlike previous timepiece designs, the current invention does not require that the student be able to read words or understand the color-coordination system that exists between the segments and current hour numerals. The current invention uses a typical clock face that has both hour and minute numerals, and novel clock hands with specially-shaped tips. With minimal effort, the student is able to tell time by simply reading the numbers which appear within the shapes at the tip of the hands. Using the shaped hands trains the student to look at the correct numbers on the clock. Once the student learns to tell time with the shaped hands, he/she can easily transition to a timepiece with typical hands.

SUMMARY OF INVENTION

The invention is directed to a device that teaches a student how to tell time from an analog clock by utilizing specially-designed hour and minute hands with shaped tips which highlight the correct hour and minute numerals, thus simplifying the reading of an analog clock.

The clock hands can be easily substituted for the hands of a standard timepiece. Furthermore, the hands are attractive, durable and inexpensive to manufacture.

Students can quickly learn to read an analog timepiece and can easily transfer their time-reading abilities to a typical timepiece.

PREFERRED EMBODIMENT

Figure 1:
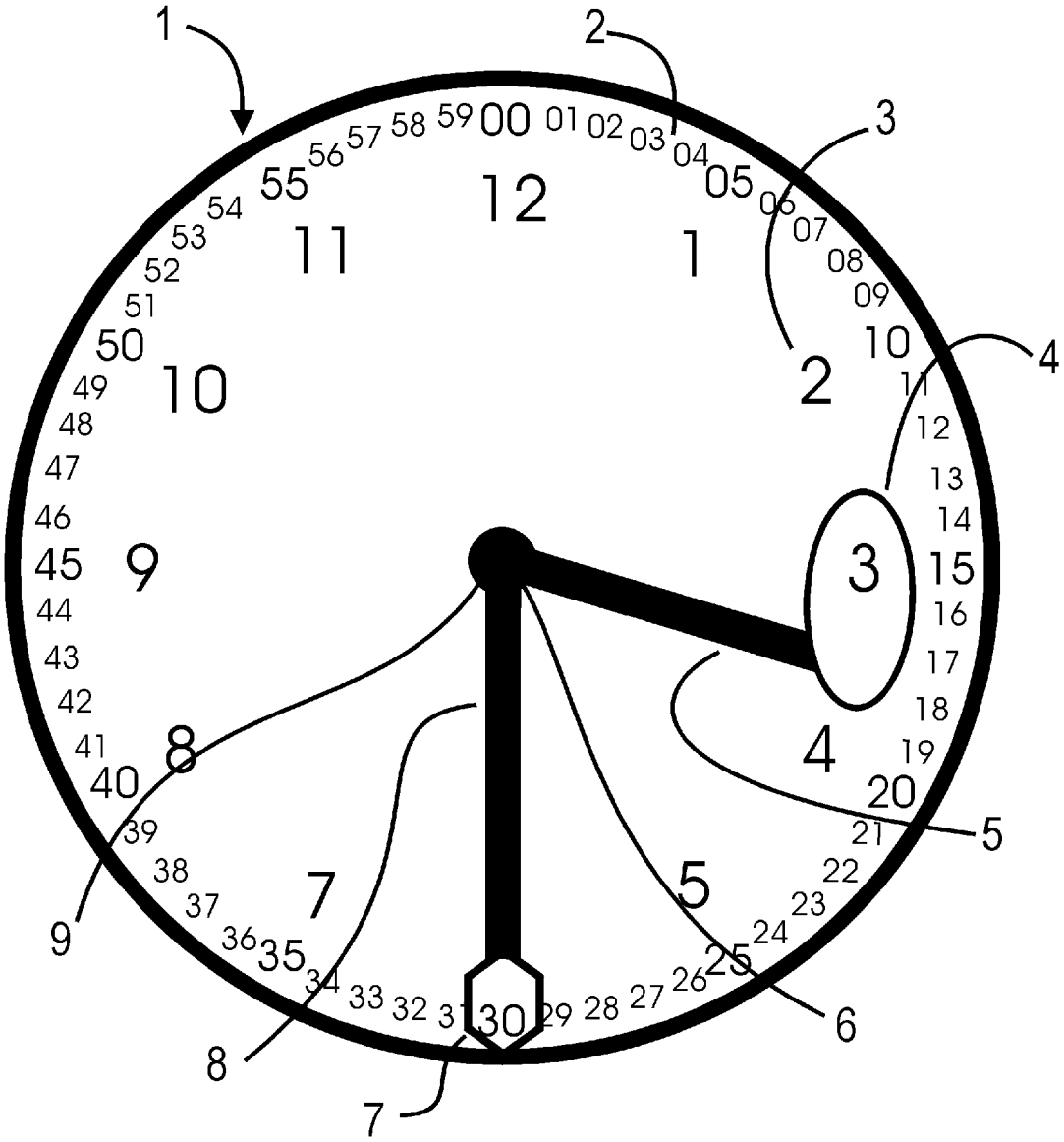
FIG. 1 is the front elevation view showing the clock hands in representative positions relative to the hour and minute scales.

With reference to the drawings, wherein the same reference numbers are used to designate the same elements throughout, FIG. 1 shows one form of a time teaching device that includes specially-designed hour and minute hands in representative positions relative to the hour and minute scales. The face of timepiece (1) is marked with the conventional numerical hour markings (3), the numbers one ("1") to twelve ("12") are distributed evenly around the face (1) at a radius of a length such that hour numerals (3) are visible within the center of the hollow shaped tip of hour hand (4). The analog face (1) is additionally marked with numerical minute markings (2), the numbers zero ("00") to fifty-nine ("59") are distributed evenly about a circle around the face (1) at a radius such that the minute numerals (2) appear within the center of the hollow-shaped tip of the minute hand (7).

Figure 2:
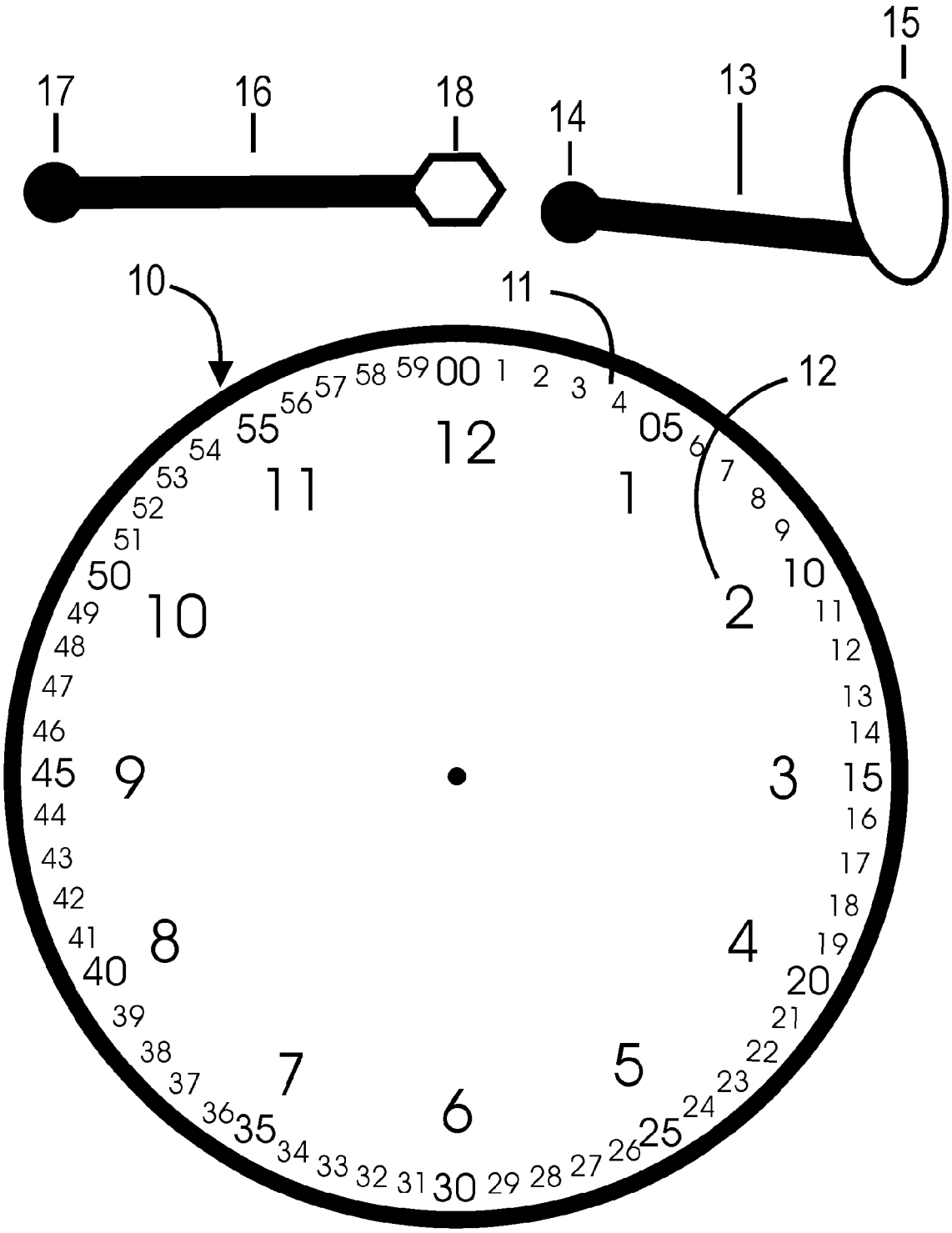
FIG. 2 is an illustration of a hands-on manipulative with clock hands that can be moved manually.

FIG. 2 shows one form of a time teaching device (10) with hour (13) and minute (16) hands that can be manually moved into position by a student. The hands may be magnetically attached, attached by some other suitable means, or placed into position with no adhesive.

Figure 3:
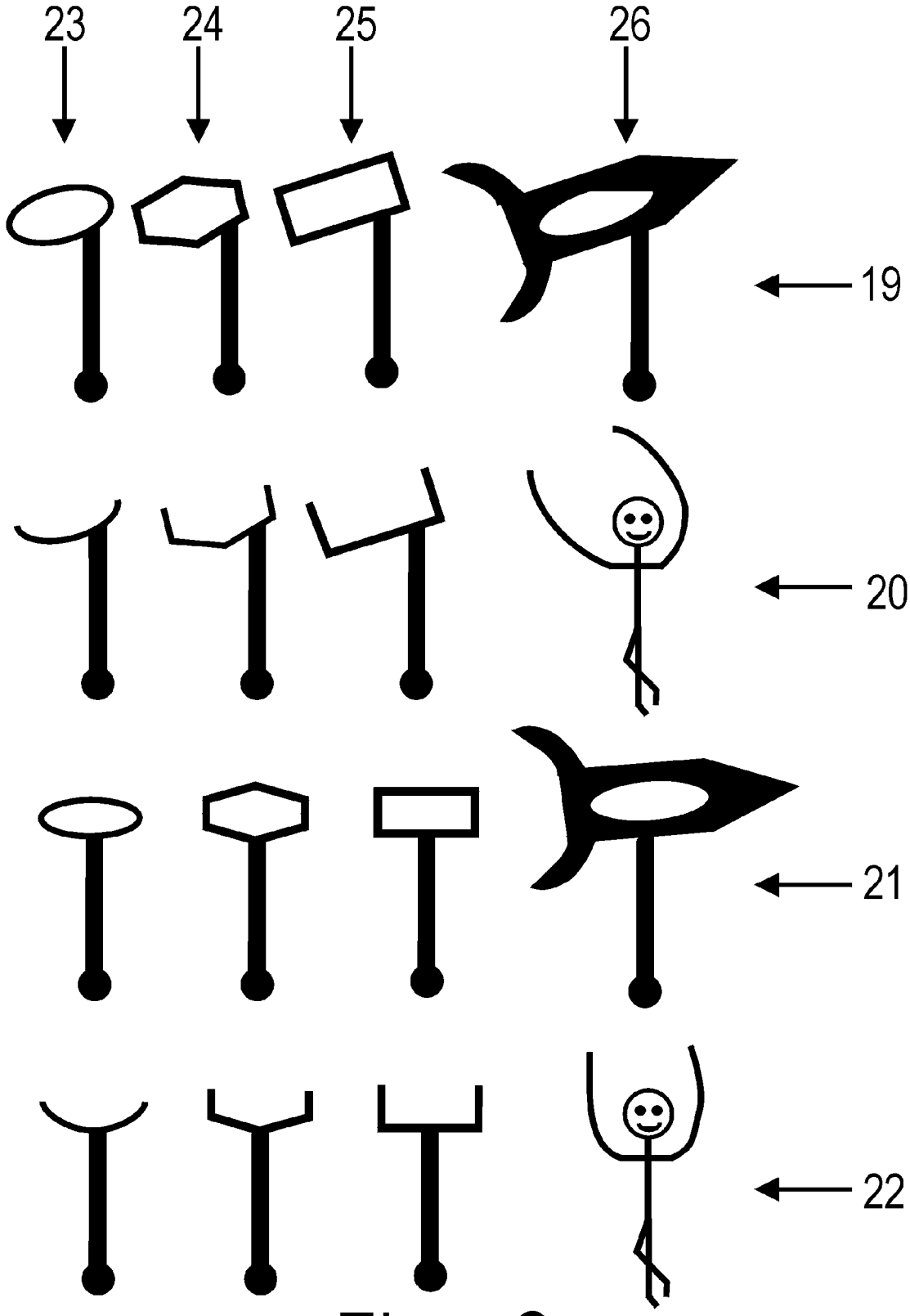
FIG. 3 illustrates some possible shape tips for the hour hand.

FIG. 3 shows some possible tip shapes for the hour hand. The hour hand tip shapes may be elliptical (23), hexagonal (24), rectangular (25), enclosed and offset (19), partially enclosed and offset (20), enclosed and centered (21), partially enclosed and centered (22) or any desired shape that highlights the current hour numeral.

Figure 4:
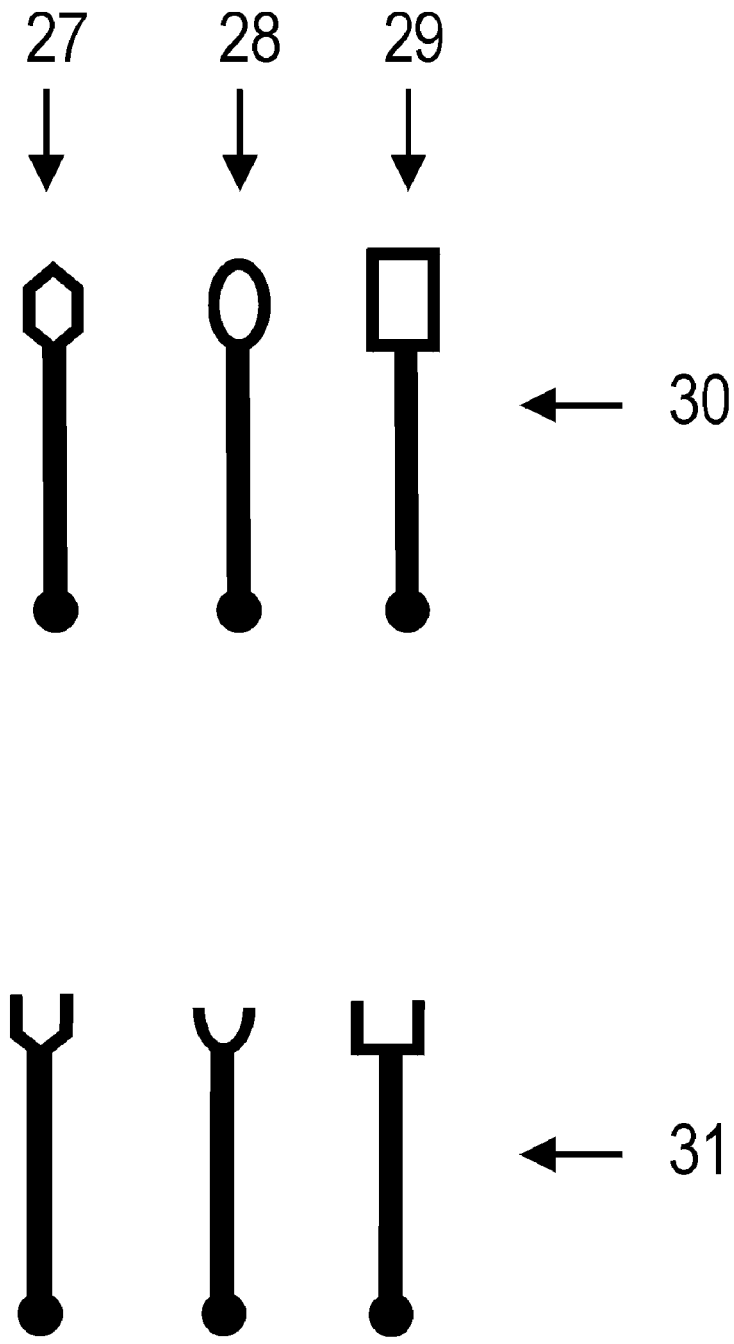
FIG. 4 illustrates some possible shape tips for the minute hand.

FIG. 4 shows some possible tip shapes for the minute hand. The minute hand tip shapes may be hexagonal (27), elliptical (28), rectangular (29), enclosed (30), partially open (31), or any desired shape that highlights the current minute numeral.

Figure 5:
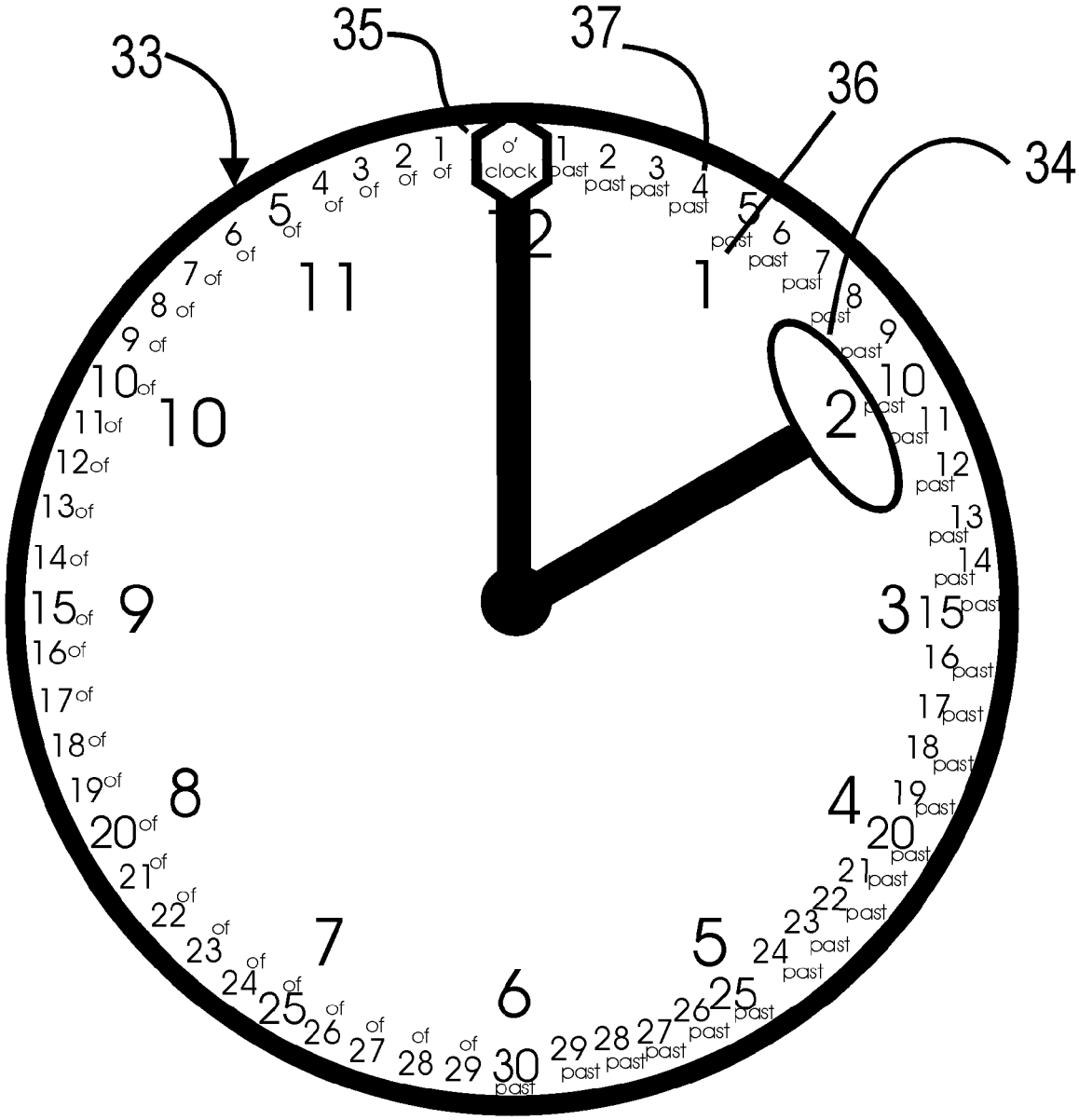
FIG. 5 is an illustration of a clock face which uses a minute scale which increases from 1 to 30 and then decreases back down to 1. This scale requires the shape on the tip of the hour hand to be centrally positioned on the tip.

FIG. 5 shows one form of a time teaching device that includes specially-designed hour and minute hands in representative positions relative to the hour and minute scales. The face of timepiece (33) is marked with the conventional numerical hour markings (36), the numbers one ("1") to twelve ("12"), distributed evenly around the face (33) at a radius of a length such that hour numerals are visible within the center of the hollow shaped tip of hour hand (34). The analog face (33) is additionally marked with numerical minute markings (37), which are distributed evenly about a circle around the face (33) at a radius such that the minute numerals appear within the center of the hollow-shaped tip of the minute hand (35). The minute numerals start at "00" and increase by units of one to "30"; they then decrease by units of one to "01". The shape of the hour hand (34) is centered on the shaft so that the correct hour numeral will be within the shape for times that are either "past" the preceding hour or "of" the next hour.

Figure 6:
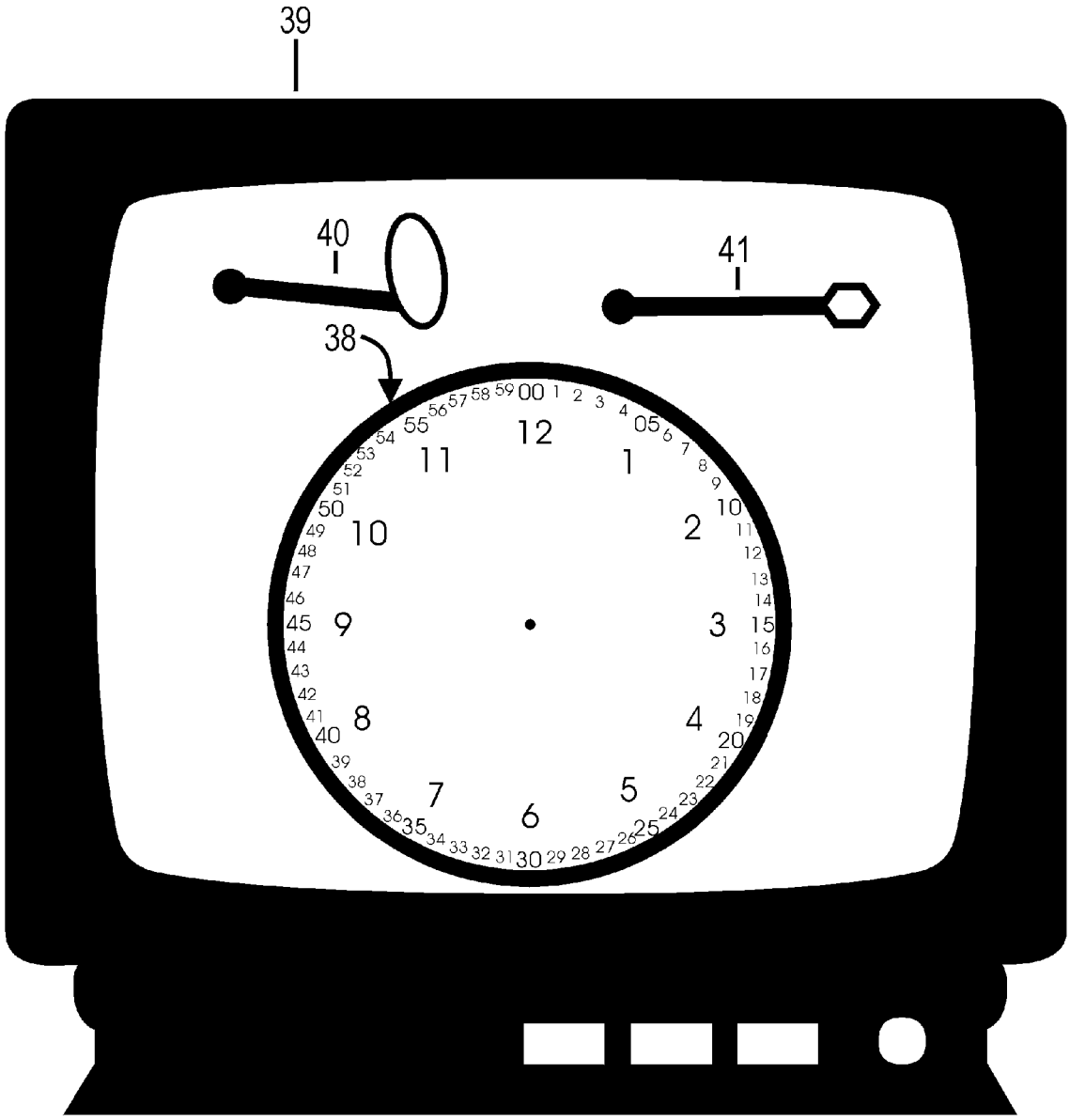
FIG. 6 shows one form of the time teaching device displayed on a computer screen with hands that can be dragged into position.

FIG. 6 shows one form of the time teaching device (38) displayed on a computer screen (39) with hands (40, 41) that can be dragged into position.

While the invention has been described with reference to specific embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore, it is intended that the invention not be limited to the particular embodiments for carrying out this invention, but that the invention will include all embodiments which may come within the language and scope of the claims.

What is claimed is:

1. A device for teaching the reading of an analog timepiece comprising, a. an analog clock face (1) having two separate numerical scales (2, 3) circumferentially and concentrically disposed thereon in spaced relationship to represent segments of time corresponding to the face of an analog clock;

b. an hour hand having a shaft (5) with two opposite ends (4, 6); one end of said shaft (6) being pivotally mounted and substantially centrally disposed proximate to the analog clock face (1); the other end of said shaft having a shape (4) attached; said shape being positioned to substantially maximize the duration that the correct hour numeral is within the boundaries of said shape for any given hour;

c. a minute hand having a shaft (8) with two opposite ends (7,9); one end (9) of said shaft being pivotally mounted and substantially centrally on the analog clock face (1); the other end of said shaft having a shape (7) attached; said shape being positioned such that when said shaft is set in a typical minute hand position, the correct minute numeral is within the boundaries of said shape.

2. The device of claim 1 wherein said hour hand (5) has a transparent closed-shaped tip (19, 21).

3. The device of claim 1 wherein said minute hand has a transparent closed-shaped tip (30).

4. The device of claim 1 wherein said hour hand has a transparent open-shaped tip (20, 22).

5. The device of claim 1 wherein said minute hand has a transparent open-shaped tip (31).

6. A device for teaching the reading of an analog timepiece comprising, a. an analog clock face (10) having two separate numerical scales (11, 12) circumferentially and concentrically disposed thereon in spaced relationship to represent segments of time corresponding to the face of an analog clock;

b. an hour hand (13) having a shaft with two opposite ends (14, 15); one end of said shaft (14) being able to be manually positioned substantially centrally disposed proximate to the analog clock face the other end (15) of said shaft having a shape attached; said shape being positioned to substantially maximize the duration that the correct hour numeral is within the boundaries of said shape for any given hour;

c. a minute hand (16) having a shaft with two opposite ends (17, 18); one end of said shaft being able to be manually positioned and substantially centrally on the analog clock face; the other end (18) of said shaft having a shape attached; said shape being able to be manually positioned such that when said shaft is set in a typical minute hand position, the correct minute numeral (11) is within the boundaries of said shape.

7. The device of claim 6 wherein said hour hand (13) has a transparent closed-shaped tip (19, 21).

8. The device of claim 6 wherein said minute hand (16) has a transparent closed-shaped tip (30).

9. The device of claim 6 wherein said hour hand (13) has a transparent open-shaped tip (20, 22).

10. The device of claim 6 wherein said minute hand (16) has a transparent open-shaped tip (31).

11. A device for teaching the reading of an analog timepiece comprising, a. an analog clock face having a numerical scale circumferentially and concentrically disposed thereon in spaced relationship to represent hours corresponding to the face of an analog clock;

b. an hour hand having a shaft with two opposite ends; one end of said shaft being positioned substantially centrally disposed proximate to the analog clock face the other end of said shaft having a shape attached; said shape being positioned to substantially maximize the duration that the correct hour numeral is within the boundaries of said shape for any given hour.

12. The device of claim 11 wherein said hour hand has a transparent closed-shaped tip.

13. The device of claim 11 wherein said hour hand has a transparent closed-shaped tip.

* * * * *